US007015871B2

(12) United States Patent
Göttl et al.

(10) Patent No.: US 7,015,871 B2
(45) Date of Patent: Mar. 21, 2006

(54) MOBILE RADIO ANTENNA ARRANGEMENT FOR A BASE STATION

(75) Inventors: Maximilian Göttl, Frasdorf (DE); Roland Gabriel, Griesstätt (DE)

(73) Assignee: Kathrein-Werke KG, Rosenheim (DE)

( * ) Notice: Subject to any disclaimer, the term of this patent is extended or adjusted under 35 U.S.C. 154(b) by 21 days.

(21) Appl. No.: 10/738,215

(22) Filed: Dec. 18, 2003

(65) Prior Publication Data

US 2005/0134512 A1 Jun. 23, 2005

(51) Int. Cl.
*H01Q 3/02* (2006.01)

(52) U.S. Cl. ..... 343/882; 343/757; 343/766; 343/880

(58) Field of Classification Search ..... 343/757, 343/761, 765, 766, 812, 813, 815, 817, 818, 343/819, 880, 882
See application file for complete search history.

(56) References Cited

U.S. PATENT DOCUMENTS

| | | | | |
|---|---|---|---|---|
| 4,792,812 | A * | 12/1988 | Rinehart | 343/781 R |
| 5,111,214 | A * | 5/1992 | Kumpfbeck et al. | 343/841 |
| 5,223,845 | A * | 6/1993 | Eguchi | 342/359 |
| 5,419,521 | A * | 5/1995 | Matthews | 248/278.1 |
| 5,469,181 | A * | 11/1995 | Yarsunas | 343/815 |
| 5,619,215 | A * | 4/1997 | Sydor | 343/766 |
| 5,710,569 | A | 1/1998 | Oh et al. | 343/817 |
| 5,969,689 | A | 10/1999 | Martek et al. | 343/758 |
| 6,366,239 | B1 | 4/2002 | Miller et al. | 342/372 |
| 6,885,352 | B1 * | 4/2005 | Lee et al. | 343/836 |
| 2003/0160731 | A1 | 8/2003 | Wensink | 343/892 |

FOREIGN PATENT DOCUMENTS

| | | | |
|---|---|---|---|
| DE | 196 27 015 | A1 | 1/1998 |
| DE | 197 22 742 | A1 | 12/1998 |
| DE | 198 23 749 | A1 | 12/1999 |
| DE | 100 12 809 | A1 | 9/2001 |
| DE | WO 02/27863 | | 4/2002 |
| DE | 101 22 696 | A1 | 11/2002 |
| DE | 101 50 150 | A1 | 5/2003 |
| DE | 102 54 490 | B3 | 4/2004 |
| EP | 0 795 257 | B1 | 9/1998 |
| EP | 1 168 499 | A1 | 1/2002 |
| EP | 1 320 908 | A1 | 6/2003 |
| EP | 1 010 214 | B1 | 8/2003 |
| EP | 1341255 | A1 | 9/2003 |
| EP | 1 175 741 | B1 | 11/2003 |
| WO | WO98/53522 | | 11/1998 |
| WO | WO 00/39894 | | 7/2000 |
| WO | WO01/28036 | A1 | 4/2001 |
| WO | WO 02/15414 | A2 | 2/2002 |
| WO | WO 02/50940 | A2 | 6/2002 |
| WO | WO 2004/047218 | A2 | 6/2004 |

* cited by examiner

*Primary Examiner*—Tho Phan
(74) *Attorney, Agent, or Firm*—Nixon & Vanderhye P.C.

(57) ABSTRACT

A mobile radio antenna arrangement for a base station includes a pivoting device which runs in the longitudinal direction and/or in the vertical direction is provided within the radome. A reflector is at least indirectly held and mounted on the pivoting device. The interior of the radome has dimensions such that the reflector which is located within the radome, and the antenna elements which are provided can be pivoted in the azimuth direction relative to the radome via the pivoting device which is located within the radome.

14 Claims, 6 Drawing Sheets

MOBILE RADIO ANTENNA ARRANGEMENT FOR A BASE STATION

FIELD

The technology herein relates to a mobile radio antenna arrangement for a base station.

BACKGROUND AND SUMMARY

Antennas and antenna arrays, in particular in the form of stationary antenna arrangements for base stations in the mobile radio field, have been known for a long time. Corresponding antenna designs are described, for example, in DE 197 22 742 A1, DE 196 27 015 A1, U.S. Pat. No. 5,710,569 or WO 00/39894.

Antenna designs such as these generally have a vertically arranged reflector which can be provided with vertically running webs or edge sections on its two opposite faces on the left and right, with these webs or edge sections generally projecting forwards from the reflector plane. Since more than one antenna element arrangement is generally provided, they are arranged one above the other with a vertical offset.

These may be single-polarized antenna element devices, although they are generally dual-polarized antenna element devices, which can transmit and receive in two mutually orthogonal polarization planes. The antenna elements and antenna element groups are in this case preferably arranged such that the two mutually perpendicular polarization planes are aligned at angles of plus 45° and minus 45° to the horizontal (and thus to the vertical).

Antennas and antenna arrays are likewise known which can transmit and/or receive with single or dual polarization not only in one frequency band, but, in particular, in two frequency bands (or more). These are also referred to as dual-band antennas or multiband antennas.

Finally, antenna arrays are also known in which two or more antenna elements are arranged not only one above the other in the vertical direction (effectively in only one column of an antenna array), but in which at least two or even more vertically running columns are provided which are positioned horizontally alongside one another, with each of the antenna elements or antenna element groups which are arranged in a column one above the other generally being fed jointly.

As mentioned, the antenna elements may in this case be in the form of dipole antenna elements, that is to say individual dipoles, for example composed of dipole pairs which are joined together in a cruciform shape, or of dipoles which form a dipole square. Antenna elements which are similar to dipole squares can also be used and, from the electrical point of view, they behave in the same way as cruciform antenna elements. Dipole structures such as these, which are also referred to as vector antenna elements are known, for example, from the cited WO 00/39894. Furthermore, however, patch antenna elements can also be used, such as those which are known, for example from WO 02/50940 A2.

Depending on the configuration of the antenna elements, on the number of the antenna elements which are used in the vertical direction and, possibly, on the two or more antenna elements which are arranged offset with respect to one another in the horizontal direction, all of these antennas or antenna arrays have a quite specific main beam direction, which is generally aligned at right angles to the reflector plane.

Since, particularly in the mobile radio field, each base station antenna is associated with a specific cell in which the mobile radio communication is handled via the relevant base station antenna, it may be necessary for the size of the relevant cell to be adjusted so that it is variable. For this purpose, it is already known for antennas of this type to be provided such that the main beam direction can be set with a different down-tilt angle. In theory, this down-tilt angle can be produced by mechanical pivoting of the entire antenna arrangement, so that the entire antenna device together with the holder on which it is mounted, the reflector plate, the antenna elements which are arranged on its front face and the radome which surrounds the antenna arrangement are pivoted manually or by a motor or motors about a horizontal axis, such that the main beam direction is lowered to a greater or lesser extent.

According to a present-day generation of corresponding antenna devices, the different setting of the down-tilt angle is produced electrically by means of different phase controls. Different phase control of the antenna elements and antenna element groups which are arranged vertically one above the other allows an appropriately different down-tilt angle to be set without any mechanical pivoting movement, solely by means of the electrical phase control.

The illustrative non-limiting technology described herein uses very simple means to improve the adjustment capability of the main beam direction for a corresponding antenna arrangement, and, in particular, antenna arrays, which can be used as a stationary antenna device for the mobile radio field.

The illustrative non-limiting technology described herein provides a simple capability for setting a main beam direction alignment which is different in the horizontal plane for an antenna having at least one antenna element which is fitted in front of a reflector.

In principle, it is already known to provide a means for antenna arrays having at least two columns for setting the main beam direction differently in the horizontal plane, that is to say in the azimuth direction. This can also be achieved by different phase control of the antenna elements or antenna element groups which are located offset in the horizontal direction. However, this is not possible with a single-column array.

In principle, it would be feasible to rotate an entire antenna arrangement including an antenna mast. However, in this case, it would also be necessary to move the cables which generally lead into the radome interior on the lower face or are connected to a holding flange on the lower face of the radome. However, in this situation, rotation would be possible, for example, if a corresponding antenna housing, that is to say the so-called radome, were attached to a housing wall or to a mount at the rear in the form of a wall.

According to the exemplary non-limiting technology described herein, provision is now made that, despite the pivoting movement about a longitudinal and/or vertical axis, essentially only the reflector and one or more antenna elements and antenna element groups which are located in front of it are pivoted, but not the radome itself, which surrounds the entire antenna arrangement including the reflector. A pivoting shaft which runs in the longitudinal or vertical direction and is provided in the interior of the radome is thus provided in order to pivot only those electrical parts of the antenna which are required for reception and for transmission (that is to say the reflector and the antenna elements), without the radome being pivoted. The radome thus has a sufficiently large interior. The radome itself can also be mounted in the same way as a conventional antenna arrangement on, for example, a post in the form of a rod, that can just as well also be mounted on a wall of a house or the like, since the radome itself is not also pivoted, even during horizontal pivoting of the main receiving direction of the antenna arrangement.

In this design, all the connections are still protected, since the electrical connections (which are normally formed on the lower face of the radome) for the supply cables are arranged to be stationary and fixed, and need not also be pivoted.

The pivoting in the azimuth direction can in principle be carried out manually. However, it is preferably carried out by a motor or motors.

Independently of the manual or motor adjustment about a vertical axis for different setting of the main beam direction in the azimuth direction, a different adjustment capability can also be provided in order to additionally vary the main beam direction in the elevation direction. In other words, the down-tilt angle can also be set differently, preferably electrically by means of different phase control of the antenna elements or antenna element groups which are arranged differently one above the other, as is known from the prior art.

Admittedly, in principle WO 02/27863 A1 and EP 1 175 741 disclose the provision of one or more antennas underneath a large protective housing, which is transparent for radio waves, with these antennas generally being offset with respect to one another in the horizontal direction and being arranged underneath the protective housing such that they can pivot. Protective housings in the form of domes are used for this purpose, underneath which the antennas are positioned such that they can be aligned. Protective housings such as these, which are generally provided for point-to-point antennas or for other specific directional antennas, have nothing in common with the specific subject matter of the application, however, which relates to a mobile radio antenna arrangement for a base station in which the radome generally surrounds the antenna element or antenna element groups, a short distance away from them and providing protection.

BRIEF DESCRIPTION OF THE DRAWINGS

These and other features and advantages will be better and more completely understood by referring to the following detailed description of exemplary non-limiting illustrative implementations in conjunction with the drawings of which.

DETAILED DESCRIPTION

Figure 1:
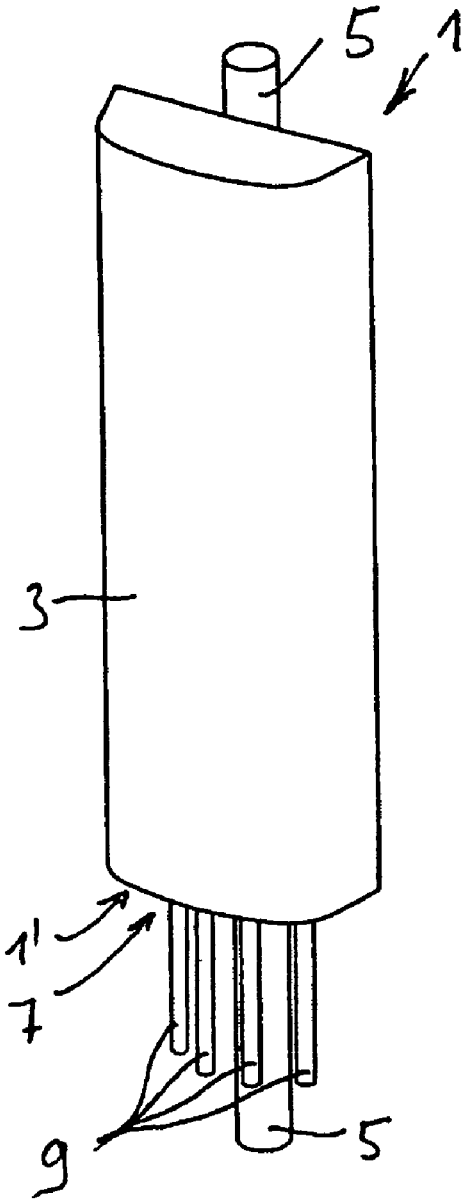
FIG. 1 shows an illustrative exemplary non-limiting schematic perspective illustration of an antenna arrangement which is mounted on a mounting post in a radome.

FIG. 1 shows a schematic perspective illustration of an exemplary illustrative non-limiting antenna arrangement 1, which has a protective housing 3, that is to say a so-called radome, which protects the electrical parts of the antenna device against environmental influences. The antenna arrangement 1 together with the radome 3 is mounted, for example, in the exemplary implementation shown in FIG. 1, on a mount in the form of a vertical post 5.

A flange 1' is normally formed on the lower face of the antenna arrangement 1 and two or more connections 7 are provided on this flange 1'. A series of cables 9, in particular supply cables for the antenna elements which are connected to the connects 7, lead to these connections 7.

Figure 2:
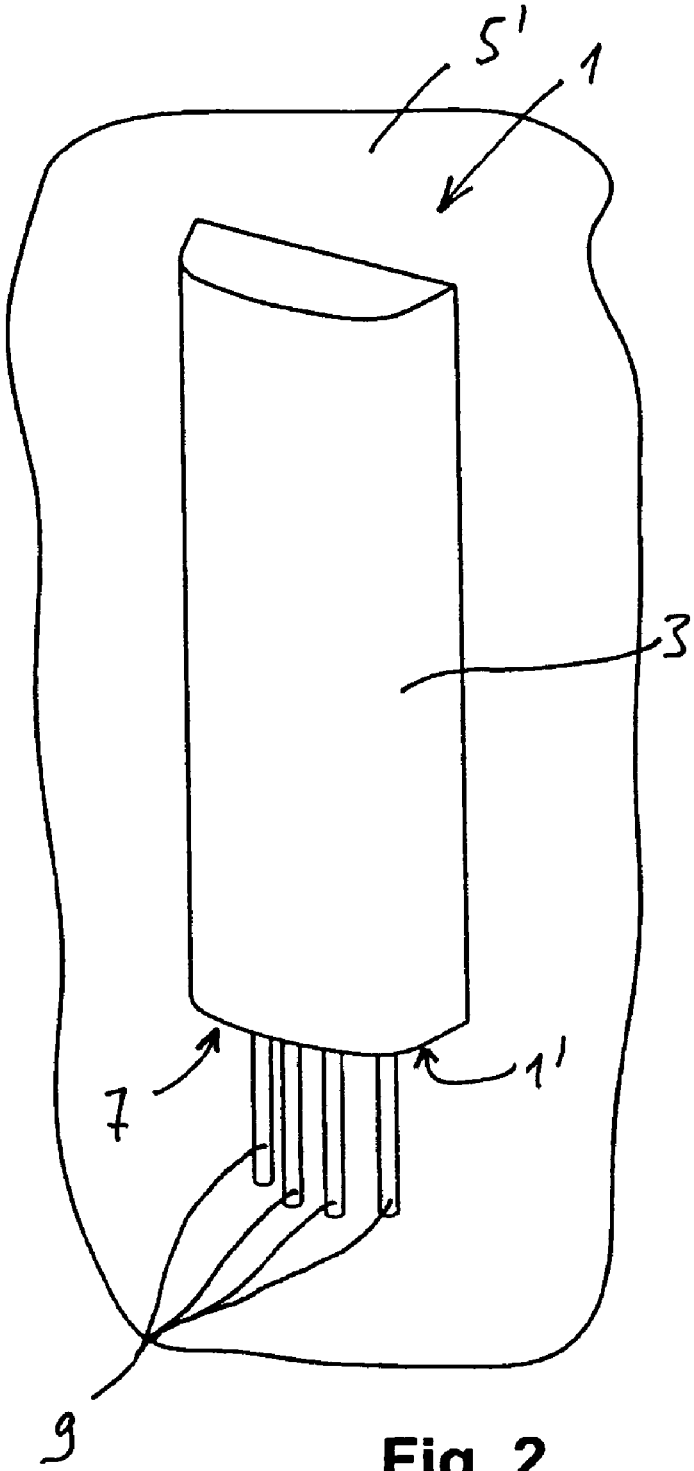
FIG. 2 shows a corresponding illustration to that in FIG. 1, in which the illustrative exemplary non-limiting antenna is mounted by means of its radome on a wall, for example, a housing wall.

In an exemplary illustrative non-limiting arrangement as shown in FIG. 2, the antenna device 1 is mounted on a different mount, that is to say not on a vertical post 5 but, for example, on a vertical wall 5'.

Widely differing antenna elements and antenna element types can be provided within the radome 3 and it is possible to use any antenna elements and antenna element types which are normally used for a stationary mobile radio antenna in the mobile radio field.

This will be explained schematically in the following text with reference to FIGS. 3 to 6.

Figure 3:
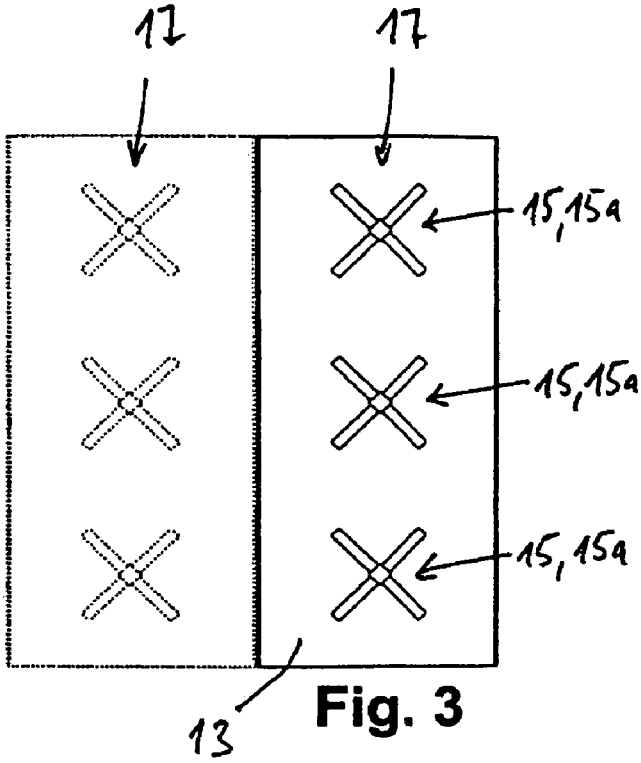
FIGS. 3 to 7 show schematic front views of an antenna array which in each case has a single column with two or more different antenna elements and antenna element groups which are arranged with one another in the vertical direction and which overall can be used for the purposes of the illustrative non-limiting exemplary arrangement.

By way of example, FIG. 3 shows a front view of an antenna arrangement 1 with a vertically running reflector 13. Webs which run forwards from the reflector plane can be formed on the reflector 13, on the left-hand or right-hand vertical edge or offset inwards from it. In the exemplary illustrative non-limiting arrangement illustrated in FIG. 3, three antenna elements 15 are provided, which are arranged one above the other and comprise, for example, a cruciform antenna element 15*a*. This is a dipole antenna element. The antenna element arrangement shown in FIG. 3 allows transmission and reception in two mutually perpendicular polarizations which are aligned at an angle of 45° to the horizontal and to the vertical. Cruciform dipole antenna elements such as these are in principle known, for example, from DE 196 27 015 A1, from DE 197 22 472 A1, or else from DE 101 50 150 A1, which are expressly referred to.

Figure 4:
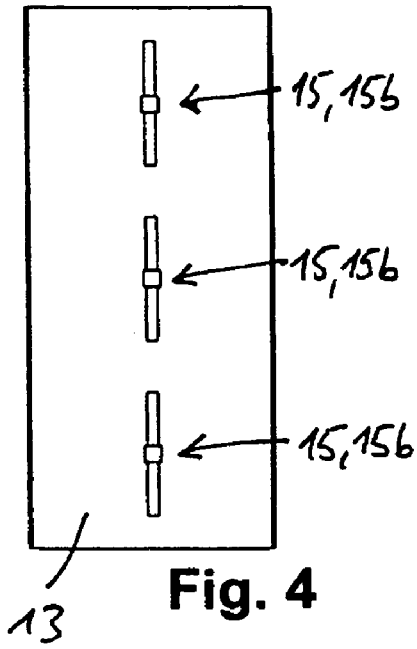

In the exemplary illustrative non-limiting arrangement shown in FIG. 4, dipole antenna elements 15*b* are used which are arranged one above the other in the vertical direction and which transmit and receive only in a vertical polarization plane. Dipole antenna devices such as these are known, for example, from U.S. Pat. No. 5,710,569.

Figure 5:
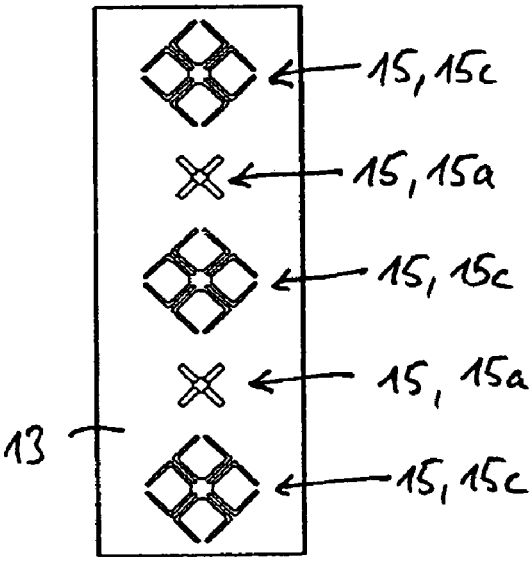

By way of example, in the exemplary illustrative non-limiting arrangement shown in FIG. 5, three antenna elements 15 which are arranged offset with respect to one another in the vertical direction are provided, each in the form of a dipole square 15*c*, which likewise once again allow transmission and reception in two mutually perpendicular polarization planes, for which reason the dipole squares run aligned at angles of +45° and −45° to the horizontal and to the vertical. Since this antenna is, for example, a dual-polarized two-band antenna, dipole crosses 15*a* are also provided between the dipole squares, and their dimensions are such that they are suitable for transmission or reception in a second frequency band. In a corresponding manner, an antenna can also in principle be equipped for a triple band range so that, in other words, two or more different antenna elements or antenna element types can in principle be provided which allow reception and/or transmission in different bands, for example in the 900 MHz band, in the 1800 MHz band and, for example, in the UMTS band and above 2000 MHz. Antenna elements such as these are known, for example, from DE 198 23 749 A1, so to this extent reference is expressly made to the publication cited above.

The corresponding antenna arrays may, in this case be designed only to transmit and/or receive in one band, or else they may be designed as dual-band antennas or, in general as multiband antennas. The schematic plan view as shown in FIG. 5 shows, for example, a multiband antenna as is known in principle from DE 198 23 749 A1, whose entire disclosure content is referred to here, and which is included in the content of the present application. The cruciform dipole antenna elements 15*a* which are shown between the dipole squares 15*c* in FIG. 5 serve in this way for transmitting and receiving in a higher frequency band.

Figure 6:
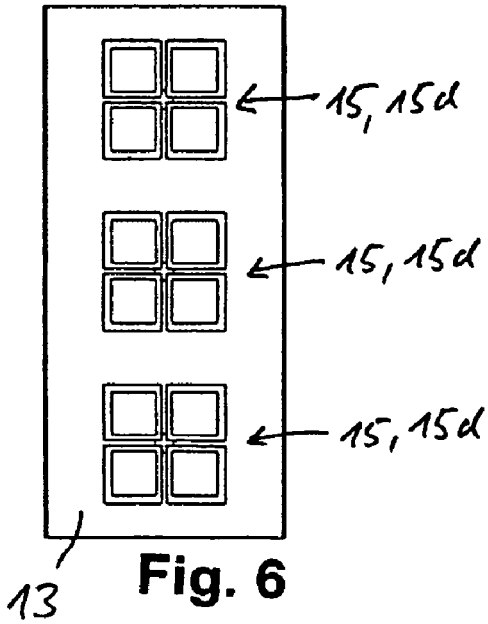

By way of example, an antenna element structure with so-called vector dipoles 15*d*, is used in the exemplary illustrative non-limiting arrangement shown in FIG. 6, as is in principle known from WO 00/39894. To this extent, reference is made to the entire disclosure content of the publication cited above, whose content is included in this application. This also allows beam reception in two mutually perpendicular polarizations, comparable to the exemplary non-limiting implementations shown in FIGS. 3 and 5.

Figure 7:
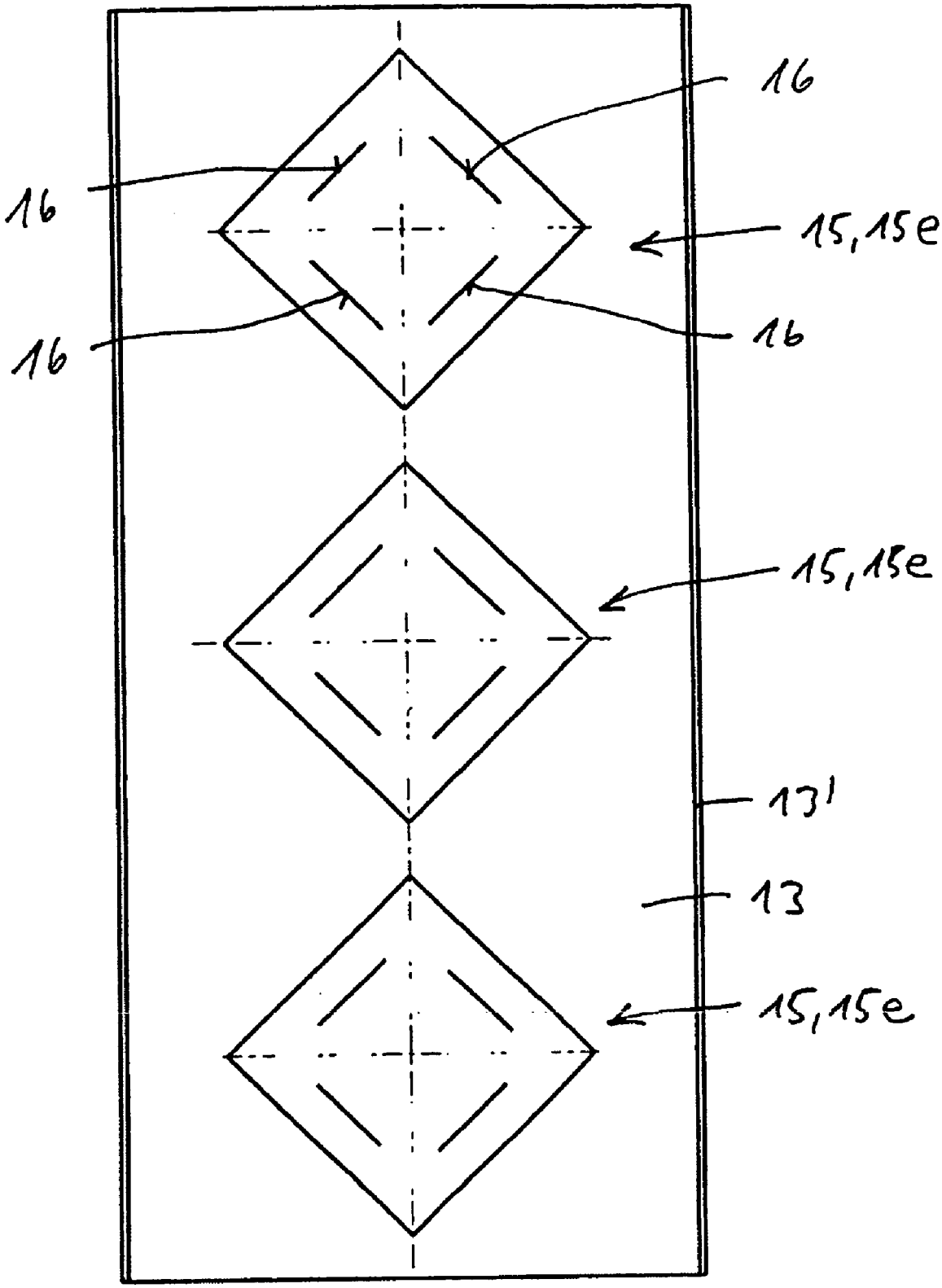

Two patch antenna elements 15*e* are used in the exemplary non-limiting implementation shown in FIG. 7, which can likewise, for example, transmit and/or receive in two polarizations at +45° and −45° to the horizontal, and may have corresponding excitation slots 16 for this purpose. Patch antennas such as these are known, for example, from the prior publication WO 02/50940 A2. (A patch antenna may also, for example, be excited by conductive or capacitive coupling.)

It is evident from the above description that the exemplary illustrative non-limiting antenna can use all known different antenna element types, without being restricted to the use of a specific antenna element type.

In this case, FIG. 3 will also be used to show that the explained antennas and antenna arrays under discussion need not necessarily have single columns. Dashed lines in FIG. 3 indicate that the single-column antenna array which is illustrated per se in FIG. 3 may also, for example, have two columns. The second column 17 is indicated by dashed lines. However, in principle, a multicolumn antenna array with more than two columns can also be used.

The rest of the design of the exemplary illustrative non-limiting antenna will be described for a single-column antenna array with reference to FIGS. 8 and 9, in which, by way of example, two or more antenna elements which are seated vertically one above the other are used, as has been described in one of the examples according to FIGS. 3, 5, 6 or 8.

Figure 8:
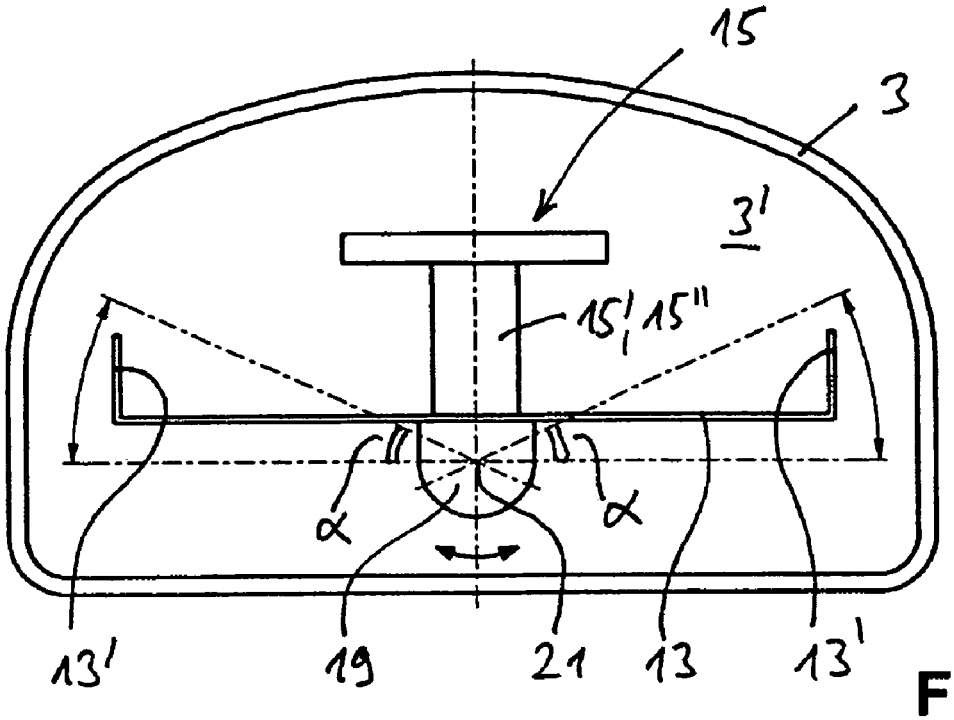
FIG. 8 shows a schematic horizontal section illustration through a single-column antenna array according to the illustrative non-limiting exemplary implementation, in the neutral basic position.

As can be seen from the horizontal cross-sectional illustration in FIG. 8, a longitudinal or vertical mount 19 is provided in the interior 3' of the radome 3 to be precise in the form of a pivoting shaft 21 which runs in the longitudinal direction or in the vertical direction.

In this exemplary illustrative non-limiting arrangement, the reflector 13 is attached to the mount device 19 which can be pivoted from left to right as illustrated by the arrow 23 in the azimuth direction, that is to say generally in the horizontal plane, and, in the illustrated exemplary non-limiting arrangement, the reflector 13 is provided on the external end sections with end sections 13' which project transversely with respect to the reflector plane. These edge sections need not necessarily be positioned at right angles to the reflector plane but may, for example, be curved outwards in opposite senses, so that the edge sections of the reflector plane which are located opposite one another are aligned such that they diverge from one another in the main beam direction. To this extent, any desired modifications are feasible.

The illustrated exemplary non-limiting arrangement also shows that an antenna element or an antenna element group 15 can be seen in front of the reflector plane and is connected at least indirectly to the reflector 13 via its mount 15' or via its balancing device 15". The actual antenna elements 15 in this exemplary illustrative non-limiting arrangement are aligned parallel to the reflector plane, seated in front of the reflector plane. The antenna element 15 may be an antenna element as explained in FIGS. 3 to 8.

An antenna such as this may be designed such that only one antenna element and only one antenna element group according to one of the exemplary non-limiting implementations shown in FIGS. 3 to 6 are used. Normally, however, two or more vertically arranged antenna elements or antenna element groups are used as is shown, for example, for three antenna elements or three antenna element groups in FIGS. 3 to 8.

The interior 3' within the radome 3 has dimensions which are sufficiently large that the reflector 13 can be pivoted either manually from the outside or by a motor or motors, together with the at least one antenna element or the two or more antenna elements 15, about the pivoting shaft 21. Thus, in the illustrated exemplary non-limiting arrangement, a pivoting range is possible from $+\alpha$ to $-\alpha$, as illustrated by the dashed-dotted lines in FIG. 7.

Figure 9:
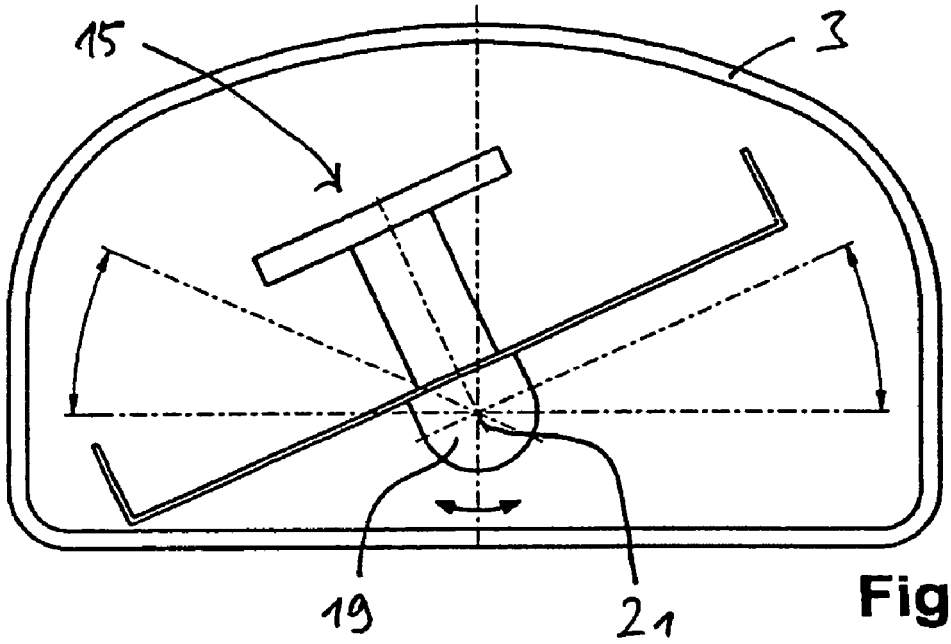
FIG. 9 shows a horizontal section illustration corresponding to that in FIG. 7, in which the antenna array according to the illustrative non-limiting exemplary implementation is pivoted at an angle $\alpha$ about a vertical axis.

In this case, FIG. 9 shows on the basis of the horizontal section illustration how the antenna arrangement 1 has been pivoted, starting from a neutral mid-position as shown in FIG. 8, to a pivoted position in which it is aligned to the maximum extent to the left. Pivoting in the opposite direction to the right is likewise feasible.

Figure 10:
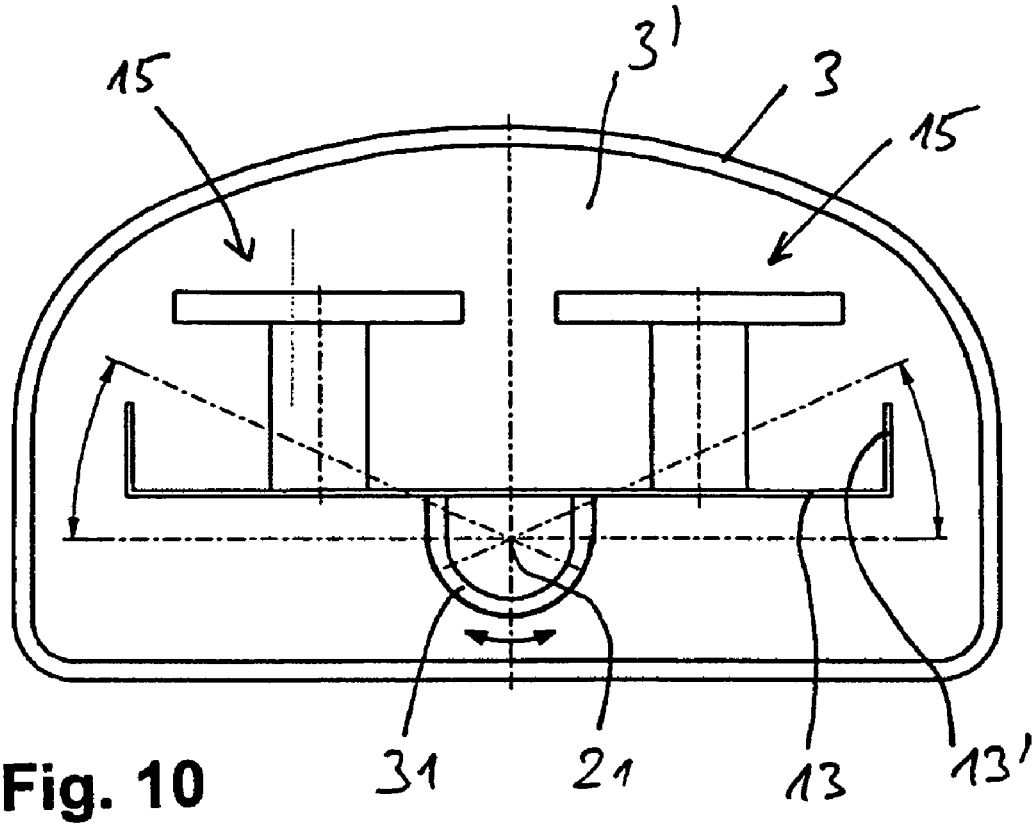
FIG. 10 shows an illustration corresponding to FIG. 7, but for an illustrative non-limting two-column antenna array.
Figure 11:
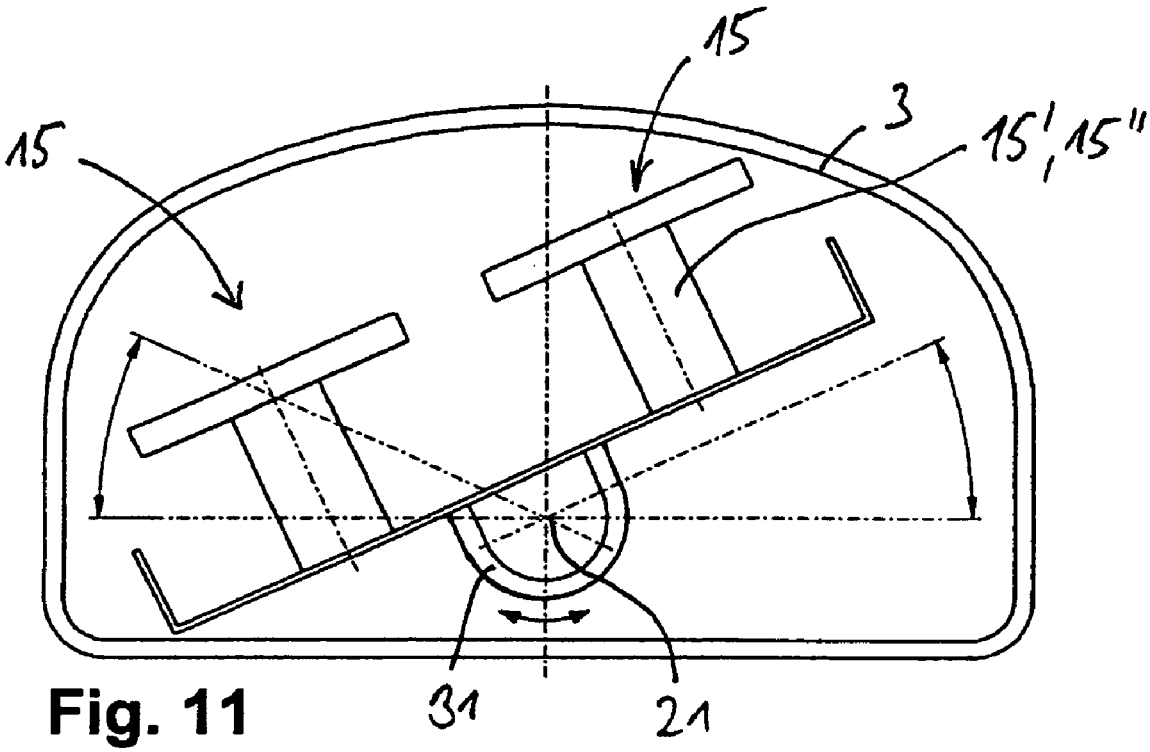
FIG. 11 shows an exemplary non-limiting illustration corresponding to FIG. 9, in which the two-column antenna array is, however, rotated through an angle $\alpha$ about a vertical axis in order to vary the main beam direction in the azimuth direction.

A similar antenna, that is to say an antenna which is at least comparable, is illustrated in the exemplary non-limiting arrangement in FIGS. 10 and 11 although, in contrast to the exemplary implementtion shown in FIGS. 9 and 10, this comprises an antenna array with two columns 27. At least one antenna element or one antenna element group, preferably two or more antenna elements or antenna element groups which are arranged offset with respect to one another in the vertical direction, is or are provided in each column.

In this exemplary non-limiting implementation as well, the antenna array can be pivoted from its neutral mid-position as shown in FIG. 10 to the pivoted position as shown in FIG. 11.

If the pivoting process is carried out by means of a motor or motors, then the electric motor 31 is preferably provided, which can be driven electrically or by means of radio, can be operated from a suitable power supply and is preferably likewise arranged in the interior of the radome, preferably at the lower end of the radome, in order in this way to control the pivoting of the antenna with the reflector 13 via one of the cables that have been laid and lead to the electric motor, or in order to carry this out by radio remote control.

In addition to the explained adjustment device for the antenna, for the purposes of pivoting movement about its pivoting axis 21, preferably an electrical lowering of the main beam direction, that is to say a different setting for the so-called down-tilt angle, can also be provided. In this context, reference is made to the already known solutions, in which, in particular, the down-tilt angle can be set differently by different phase control of the antenna elements which are located vertically one above the other. Merely for the sake of completeness, it should be mentioned that the pivoting axis 21 need not necessarily be aligned exactly vertically. The axis may be pivoted slightly forwards, for example, by virtue of the design, so that the antenna is already mechanically set to a specific down-tilt angle. Pivoting about the longitudinal axis 21, as described, can equally well be carried out.

Figure 12:
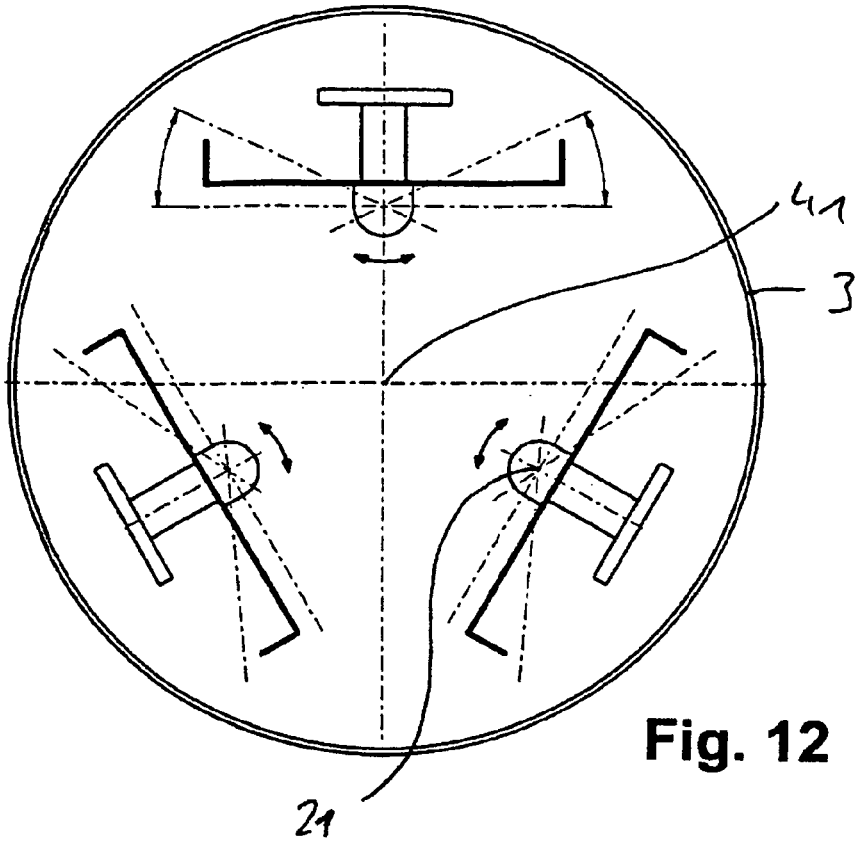
FIG. 12 shows an exemplary non-limiting horizontal cross-sectional illustration through an antenna arrangement having three single-column antenna arrays which are arranged offset to 120° with respect to one another, in the basic position.
Figure 13:
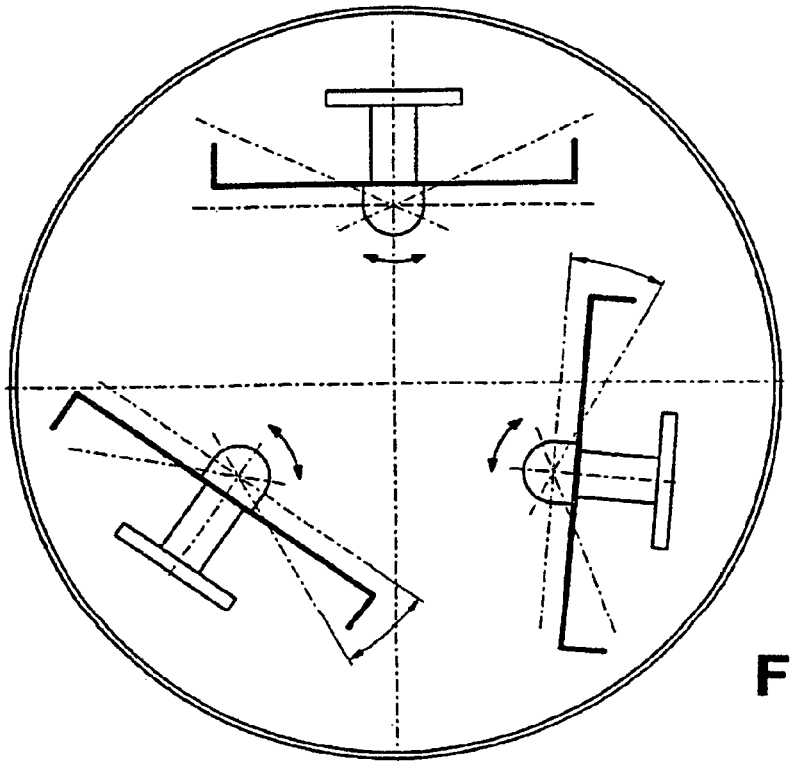
FIG. 13 shows an exemplary non-limiting illustration corresponding to FIG. 12, in which two single-column antenna arrays are pivoted through an angle $\alpha$ in the azimuth direction within a circular radome.

FIGS. 12 and 13 show a further exemplary illustrative non-limiting arrangement in which three single-column antenna arrays are arranged within a hollow-cylindrical radome 3 and are each designed in accordance with the exemplary illustrative non-limiting arrangement shown in FIGS. 8 and 9 (type: 3-dB beamwidth 65° and 1–3 dB, lobe width 120° at the −10 dB level; this normally extends to the supply).

All three antenna arrays are arranged and aligned offset through 120° with respect to one another about a common center 41, which generally represents the horizontal longitudinal axis of the radome 3, with the entire surrounding area of an antenna such as this for a base station being illuminated, for example, with each antenna array providing an average coverage of 120°. Each of these single-column antenna arrangements can in each case be pivoted about its center axis 21 in the described manner, thus allowing for different setting in the horizontal alignment. For this purpose, each individual antenna can be pivoted through an angle of $+\alpha$ or $-\alpha$ about its longitudinal axis 21, preferably not manually, but once again via a motor 31, which can preferably be controlled remotely, or can be controlled via the electrical supply line or other lines. The motor is also preferably arranged within the radome. The radome itself is in this case stationary, and is not also pivoted.

In some circumstances, the radome may have a cross-sectional shape that is not hollow cylindrical.

In contrast to the exemplary illustrative non-limiting arrangement illustrated in FIGS. 12 and 13, however, antenna arrays having two or even more columns may likewise be provided here, once again, instead of a single-column antenna array, and these antenna arrays may, for example, also be arranged offset through 120° with respect to one another in the circumferential direction and may be aligned in their basic position, in which case two-column antenna arrays such as this which has been explained, with reference to FIGS. 10 and 11 may also likewise be capable of pivoting through an angle $+\alpha$ or $-\alpha$, preferably by remote control. However, in contrast to the illustration shown in FIGS. 12 and 13, two single-column or multicolumn antenna arrays or else four single-column or multicolumn antenna arrays or two or more such antenna arrays can be arranged offset in the circumferential direction in a radome 3 such as this. There is no need to restrict the total number to three, corresponding to the exemplary illustrative non-limiting arrangement shown in FIGS. 12 and 13.

While the technology herein has been described in connection with exemplary illustrative non-limiting arrangements, the invention is not to be limited by the disclosure. The invention is intended to be defined by the claims and to cover all corresponding and equivalent arrangements whether or not specifically disclosed herein.

The invention claimed is:

1. A mobile radio antenna arrangement for mounting on a mast or other structure as a base station, the antenna arrangement being designed in the form of an antenna array comprising two or more antenna elements or antenna element groups arranged one above the other in the vertical direction, the antenna elements or antenna element groups being arranged in front of a reflector which extends in the vertical direction, the antenna elements or antenna element groups and the reflector being accommodated in a radome, the antenna elements or antenna element groups being arranged in front of the reflector prefabricated as a unit, said antenna arrangement comprising:

a pivoting device which runs in the longitudinal direction and/or in the vertical direction within the radome, the reflector at least indirectly being held and mounted on the pivoting device, wherein the interior of the radome has dimensions such that the reflector, which is located within the radome, and the antenna elements are pivotable in the azimuth direction relative to the radome via the pivoting device which is located within the radome.

2. The antenna arrangement according to claim 1, wherein the antenna arrangement together with the antenna elements or antenna element groups, the reflector and the associated radome are prefabricated as a single modular unit.

3. The antenna arrangement according to claim 1, wherein the antenna arrangement has a single column.

4. The antenna arrangement according to claim 1, wherein the antenna arrangement has at least two columns.

5. The antenna arrangement according to one of claim 1, wherein the antenna arrangement can be pivoted through an angle ±30° about the pivoting device or shaft.

6. The antenna arrangement according to claim 1, wherein feed and control cables, lead to connections on the radome without being pivoted.

7. The antenna arrangement according to claim 1, further including a means of pivoting arrangement for pivoting the antenna elements in the azimuth direction.

8. The antenna arrangement according to claim 1, further including at least one motor for pivoting the antenna elements.

9. The antenna arrangement according to claim 8, further including a remote control for controlling the pivoting position of the antenna elements relative to the shaft electrically and remotely.

10. The antenna arrangement according to claim 9, further including a motor arranged within the radome in the area of the pivoting device, by which means the pivoting movement being carried out.

11. The antenna arrangement according to claim 1, wherein a different setting of the down-tilt angle being produced, electrically, by different phase control of the antenna elements which are arranged vertically one above the other.

12. The antenna arrangement according to claim 1, wherein at least two single-column or multi-column antenna arrays are arranged in the radome and each pivot about their own shaft in each case as far as an angle of $+\alpha$ and/or $-\alpha$.

13. The antenna arrangement according to claim 1, wherein at least two single-column or multi-column antenna arrays are arranged in a common radome, which transmit in different azimuth directions and being set differently to one another to an angle $+\alpha$ or $-\alpha$ about their longitudinal axis.

14. The antenna arrangement according to claim 1, wherein the radome has a hollow cylindrical cross section.

* * * * *